United States Patent [19]

Bergmann et al.

[11] Patent Number: 4,602,968

[45] Date of Patent: Jul. 29, 1986

[54] MANGANESE OXIDE COATED NICKEL BASE CONSTRUCTION PARTS FOR MEDIUM CONTAINING GASEOUS HYDROGEN ISOTOPE

[75] Inventors: Walter Bergmann, Hanau; Horst Ebinger, Bad Soden-Salmünster; Günther Luthardt, Rodenbach; Volker E. Portscher, Haibach, all of Fed. Rep. of Germany

[73] Assignee: Nukem GmbH, Hanau, Fed. Rep. of Germany

[21] Appl. No.: 774,523

[22] Filed: Sep. 10, 1985

[30] Foreign Application Priority Data

Oct. 19, 1984 [DE] Fed. Rep. of Germany ..... 3438339

[51] Int. Cl.[4] ..... C23F 7/02

[52] U.S. Cl. ..... 148/31.5; 148/11.5 N; 148/409; 148/410; 148/427; 148/6; 148/6.3; 138/177; 165/177

[58] Field of Search ..... 148/31.5, 409, 410, 148/427, 11.5 N, 6, 6.3; 138/177

[56] References Cited

U.S. PATENT DOCUMENTS

| | | | |
|---|---|---|---|
| 4,031,921 | 6/1977 | Maroni et al. | 138/177 |
| 4,050,250 | 9/1977 | Davis | 165/104 R |
| 4,129,464 | 12/1978 | Matthews et al. | 148/410 |
| 4,478,648 | 10/1984 | Zeilinger et al. | 148/6.3 |
| 4,555,275 | 11/1985 | Tobin | 148/6.3 |

FOREIGN PATENT DOCUMENTS

| | | | |
|---|---|---|---|
| 2836745 | 6/1979 | Fed. Rep. of Germany | 148/6.3 |
| 3104112 | 8/1982 | Fed. Rep. of Germany . | |
| 3108160 | 8/1982 | Fed. Rep. of Germany . | |
| 3215314 | 11/1983 | Fed. Rep. of Germany . | |
| 5956567 | 4/1984 | Japan | 148/410 |
| 2092621 | 8/1982 | United Kingdom | 148/6.3 |

*Primary Examiner*—Veronica O'Keefe
*Attorney, Agent, or Firm*—Cushman, Darby & Darby

[57] ABSTRACT

There are described construction parts for gaseous hydrogen containing media which construction parts are made of a nickel alloy containing 40 to 70% nickel, 15 to 30% chromium, 0 to 20% cobalt, 5 to 10% molybdenum, and 0 to 20% iron and which construction parts have optimum hydrogen permeation prevention properties. For this purpose, the alloys contain 0.5 to 0.8% manganese and the parts are provided with a 1 to 10 μm thick oxide coating by treating at a temperature of 850° to 1000° C. in an oxidizing atmosphere.

7 Claims, No Drawings

MANGANESE OXIDE COATED NICKEL BASE CONSTRUCTION PARTS FOR MEDIUM CONTAINING GASEOUS HYDROGEN ISOTOPE

BACKGROUND OF THE INVENTION

The subject matter of the invention is construction parts for gaseous hydrogen isotope containing media, especially pipes for the transfer of process heat which are made of nickel-based alloys containing 40 to 70% nickel, 15 to 30% chromium, 0 to 20% cobalt, 5to 10% molybdenum, and 0 to 20% iron.

For example, in the enrichment of coal, in methane reformation with steam or in petrochemistry, there are required construction materials which in addition to a good high temperature resistance at 850° to 1100° C. and oxidation resistance also must have a resistance to permeating hydrogen atoms. There are reasons to take the necessary energy for the enrichment of coal from nuclear sources, for example, from a high temperature reactor employing helium as heat carrier. Since this heat carrier also can contain the radioactive hydrogen isotope tritium, whose passage into the product gas of the enrichment of coal must be prevented as far as possible, there are required for the usable construction materials to an especial degree high resistance to permeation at high temperatures.

The permeation values for hydrogen or tritium with known, for the most part nickel and chromium containing, high-temperature materials are very neat to each other, but these values are impermissibly high, above all when employed in the nuclear area.

Therefore, it has already been proposed to provide these types of high temperature materials with a hydrogen permeation-retarding oxide layer.

In German OS 3104112, there is described an oxide coating which is produced in general on all high temperature alloys. However, there is the disadvantage that no definite resistance to the permeation of hydrogen can be produced, so that a practical employment of such material provided with an oxide coating is problematical because of the strongly fluctuating retardation of hydrogen permeation, likewise the adjustment of the thickness of the oxide coating to the permeation problem in each case in using the entire spectrum of high temperature alloys. In some cases, the resistance effect of oxide layers differs only insignificantly from the substrate. At the same substrate quality within the suggested frame of composition of high temperature alloys and at the same thickness of oxide coating furthermore there are in part considerable fluctuations in preventing permeation dependent on the tolerance permitted in the alloy composition and the impurities. The oxide coatings described in the above-mentioned patent publication and also in German OS 3108160 and 3215314, therefore, indeed are suited as corrosion protection coatings but are not reliable as hydrogen permeation barriers.

Therefore, the problem of the present invention is to provide construction parts for media containing gaseous hydrogen isotopes, especially pipes for the transfer of process heat made of nickel-based alloys containing 40 to 70% nickel, 15 to 30% chromium, 0 to 20% cobalt, 5 to 10% molybdenum, and 0 to 20% iron which lead to an optimum formation of fixed permeation-preventing barriers and, therefore, produce high quality of resistance to permeation for destined employment.

SUMMARY OF THE INVENTION

The problem was solved according to the invention by providing in the construction parts, at least in the surface zone, 0.5 to 0.8% manganese and providing the parts during a temperature treatment at 850° to 1000° C. in an oxidizing atmosphere in a plurality of steps during a total treatment of 15 to 45 hours with a 1 to 10 μm thick oxide layer.

It has unexpectedly been found that alloying in of 0.5 to 0.8% manganese in combination together with a 1 to 10 μm thick oxide layer which is applied in a plurality of steps at 850° to 1000° C. in an oxidizing atmosphere during a treatment time totalling 15 to 45 hours results in a fixed reproducible outstanding prevention of permeation by hydrogen isotopes.

If, for example, the preventing effect of known customary nickel-based alloys which contain 0.08% Mn are provided with an oxide coating and is measured as 40, in which case there is applied to the substrate alone a value of 1, there results with oxide layers which have been produced the same way, but on alloys with a manganese content of 0.5, respectively, 0.77% a preventing effect of 900, respectively, 780. This same nickel-based alloy with a comparable oxide coating but with a manganese content of over 0.8%, however, again has a decreasing permeation prevention value, which is measured in known manner.

Thus, with the construction parts of the invention, it is possible to put in a desired high permeation prevention, whereby the high temperature and strength as well as corrosion properties remain unchanged.

In an advantageous development of the invention, the construction parts on the surface are first coated with a 0.1 to 1.0 μm thick manganese coating, e.g., by vapor treatment, and subsequently the manganese content of 0.5 to 0.8% established in the surface zone of the construction parts by diffusion treatment, for example, at 950° C., whereupon the formation of the oxide coating follows.

Thus, if desired, an alloy of 0.5 to 0.8% manganese as total content over the entire volume of the construction parts is avoided in the event the laying out of the construction requires this in special uses, e.g., for reasons of weldability. With this advantageous development, there is produced the same unexpectedly high prevention of permeation without placing special additional requirements on the diffusion zone.

It is especially favorable if the formation of the oxide coating is carried out in three steps and the treatment time with a nickel-based alloy having a high iron content and slight cobalt content, e.g., 19% Fe and 2% Co, is about 5 hours per step and with a nickel-based alloy without iron and higher cobalt content, e.g., 0% Fe and 12% Co, about 15 hours per step, whereby the oxidizing atmosphere consists of a steam-hydrogen mixture (volume ratio from 10:1 to 1:1) or of pure steam. This three-step treatment completely cures intermediately formed coating faults and leads to an oxide coating of great quality.

However, there also can be used two, four, or more treatment steps whose total time is between about 15 to about 45 hours. As oxidizing atmosphere, there can also be suited CO or $CO_2$.

The construction part can be a pipe (or other container) for holding a hydrogen isotope, e.g., hydrogen itself, deuterium, or tritium.

Before applying the oxide coating, the construction part to be treated is cleaned and suitably subjected to a hydrogen annealing. Thereby, the construction part is clean on the surface and the surface worked on by the surface preparation is recrystallized.

The construction parts can consist essentially of or consist of the stated materials.

Unless otherwise indicated, all parts and percentages are by weight.

The following examples illustrate in more detail the advantages of the construction parts of the invention.

DETAILED DESCRIPTION

EXAMPLE 1

There were melted, forged, rolled, and recrystallizingly annealed batches of a nickel-chromium-cobalt-molybdenum alloy having the composition of about 0.07% carbon, 21.5% chromium, 1.15% aluminum, 0.5% titanium, 11.9% cobalt, 8.6% molybdenum, 0.07% silicon, and 0.08%; 0.5%, 0.77%; and 1.1% manganese, balance excluding unavoidable impurities being nickel. Samples were prepared from these materials and pretreated under identical conditions and provided with an oxide coating. The pretreatment included a mechanical grinding operation (200–1200 grit, preferably 1200 grit) and a hydrogen annealing for 0.5–3 hours at 900°–1000° C., preferably at 950° C. Subsequently, there was carried out a three-step oxidation at 850°–1000° C., each step for 15 hours, preferably at 925° C. with a steam-hydrogen mixture (volume ratio from 10:1 to 1:1) or with pure steam. Subsequently, the samples were examined for their ability to prevent permeation of hydrogen. Thereby, samples with a manganese content of 0.08% only measured a preventing value of 40 while samples with a manganese content of 0.5%, respectively, 0.77% had preventing values of 900, respectively, 780. Samples with a manganese content of 1.1% on the contrary produced a lower permeation prevention of 400. As stated above, the prevention value of the bare alloy was 1.

EXAMPLE 2

There were prepared samples from batches of a nickel-chromium-iron-molybdenum soft alloy containing about 0.06% carbon, 0.1% aluminum, 21% chromium, 18.9% iron, 8.7% molybdenum, 0.6% tungsten, 0.4% silicon, and manganese contents of 0.37%, respectively, 0.7%, balance nickel exclusive of unavoidable impurities, and they were pretreated under identical conditions and provided with an oxide coating. The pretreatment included a mechanical grinding process with 1200 grit and a hydrogen annealing of one hour at 1000° C. There followed three oxidations, each time for 5 hours with pure steam. Subsequently, the samples were examined for their ability to prevent permeation of hydrogen. Thereby, there was measured on the samples with 0.37% Mn a preventing effect of only about 50, but on the samples with 0.7% manganese, there was measured a permeation prevention of 1100. If the oxide coatings are removed from the metal surface, then the lower permeation values are again measured which correspond to the clean, none-oxide coated metal.

In contrast to the present invention, however, no improved prevention of permeation for hydrogen, deuterium, and tritium were obtained if there was, e.g., vapor deposited chromium artificially from the outside and this chromium layer subsequently oxidized under the conditions given in the examples. This means that there is a causal connection between the specified manganese content of the invention and the formation of the particular, specified permeation-preventing oxide coatings on the construction part.

The entire disclosure of German priority application P3438339.5 is hereby incorporated by reference.

What is claimed is:

1. A construction part for a gaseous hydrogen isotope containing medium, said construction part being made of a nickel-base alloy consisting essentially of 40 to 70% nickel, 15 to 30% chromium, 0 to 20% cobalt, 5 to 10% molybdenum, and 0 to 20% iron and at least in the surface of the construction part containing 0.5 to 0.8% manganese, said construction part having been treated at 850° to 1000° C. in an oxidizing atmosphere in a plurality of steps for a total of 15 to 45 hours to form a 1 to 10 μm thick oxide coating on the construction part whereby the permeation of the hydrogen isotope through the construction part is prevented.

2. A construction part according to claim 1 which is a pipe suitable for the transfer of process heat.

3. A construction part according to claim 1 prepared by first applying a 0.1 to 1.0 μm thick manganese coating to a nickel-based alloy consisting essentially of 40 to 70% nickel, 15 to 30% chromium, 0 to 20% cobalt, 5 to 10% molybdenum, and 0 to 20% iron and then obtaining a manganese content of 0.5 to 0.8% in the surface zone of the construction part by diffusing the manganese into the surface zone.

4. A construction part according to claim 1 wherein there are 2 to 4 oxidizing steps.

5. A construction part according to claim 3 wherein there are three oxidizing steps and the alloy is high in iron and low in cobalt and each step is about 5 hours and the oxidizing atmosphere is steam or a steam-hydrogen mixture.

6. A construction part according to claim 1 wherein there are three oxidizing steps and the alloy is high in iron and low in cobalt and each step is about 5 hours and the oxidizing atmosphere is steam or a steam-hydrogen mixture.

7. A construction part according to claim 3 wherein there are three oxidizing steps and the alloy is free of iron and high in cobalt and each step is about 15 hours and the oxidizing atmosphere is steam or a hydrogen-steam mixture.

* * * * *